US008128785B2

(12) United States Patent
Ottelin

(10) Patent No.: US 8,128,785 B2
(45) Date of Patent: Mar. 6, 2012

(54) METHOD AND APPARATUS FOR FILLING AND CLEANING A PULP TOWER

(75) Inventor: Juha Ottelin, Tarvasjoki (FI)

(73) Assignee: Sulzer Pumpen AG, Winterhur (CH)

( * ) Notice: Subject to any disclaimer, the term of this patent is extended or adjusted under 35 U.S.C. 154(b) by 0 days.

(21) Appl. No.: 12/440,008

(22) PCT Filed: Aug. 15, 2007

(86) PCT No.: PCT/EP2007/058476

§ 371 (c)(1),
(2), (4) Date: Nov. 6, 2009

(87) PCT Pub. No.: WO2008/028771

PCT Pub. Date: Mar. 13, 2008

(65) Prior Publication Data

US 2010/0132899 A1 Jun. 3, 2010

(30) Foreign Application Priority Data

Sep. 7, 2006 (FI) ..... 20065557

(51) Int. Cl.
*D21G 3/00* (2006.01)

(52) U.S. Cl. ..... 162/272

(58) Field of Classification Search ..... 162/48, 162/272

See application file for complete search history.

(56) References Cited

U.S. PATENT DOCUMENTS

| | | | |
|---|---|---|---|
| 2,990,710 | A | 7/1961 | Burling |
| 3,599,448 | A | 8/1971 | Green |
| 3,964,962 | A | 6/1976 | Carlsmith |
| 2005/0126725 | A1 | 6/2005 | Brottgardh et al. |

FOREIGN PATENT DOCUMENTS

| | | | |
|---|---|---|---|
| WO | WO 97/39181 | A1 | 10/1997 |
| WO | WO 98/44188 | A1 | 10/1998 |
| WO | WO 01/49927 | A1 | 7/2001 |
| WO | WO 02/48451 | A1 | 6/2002 |

*Primary Examiner* — Mark Halpern

(74) *Attorney, Agent, or Firm* — Kilpatrick Townsend & Stockton LLP

(57) ABSTRACT

The present invention relates to a method and apparatus for filling and cleaning a pulp tower. The invention is most suitable for filling and cleaning high-consistency pulp towers, bleaching towers, storage tanks and similar towers containing fiber suspensions, of the wood-processing industry. The apparatus and method according to the invention for filling and cleaning a pulp tower, in which method pulp is fed into the pulp tower either through its cover (10) or at least feed devices (24) arranged at its top, are characterized in that the space surrounding the feed device (24) is washable at the same time as the pulp is fed into the tower by means of washing devices (28, 30, 32) arranged in connection with the feed devices.

13 Claims, 1 Drawing Sheet

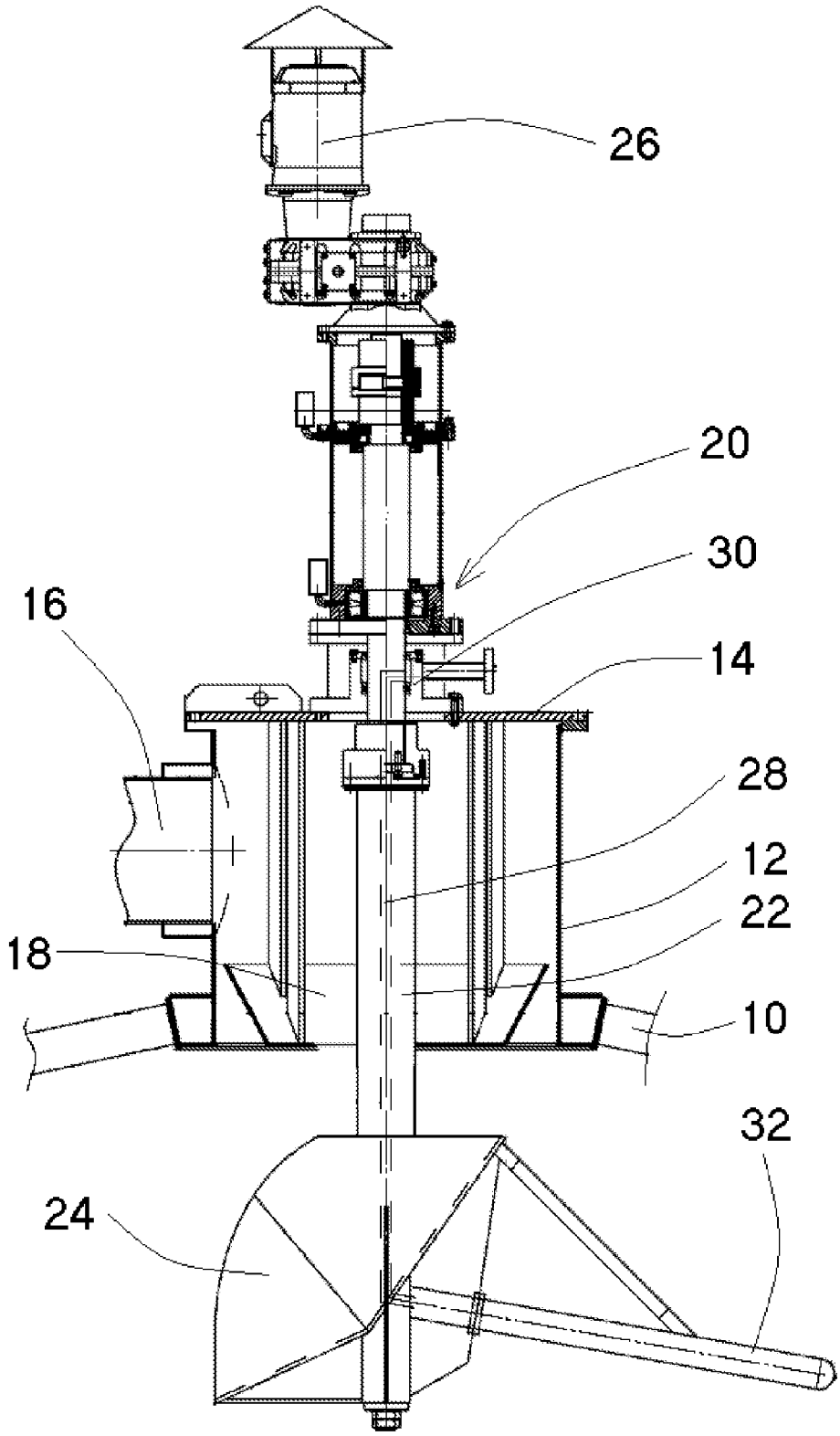
26
20
30
16
14
28
12
22
18
10
32
24

METHOD AND APPARATUS FOR FILLING AND CLEANING A PULP TOWER

CROSS REFERENCE TO RELATED APPLICATIONS

This application is a National Stage of International Application No. PCT/EP2007/058476 filed Aug. 15, 2007 and which claims the benefit of Finland Patent Application No. 20065557, the disclosures of all applications being incorporated herein by reference.

BACKGROUND OF THE INVENTION

The present invention relates to a method and apparatus for filling and cleaning a pulp tower. The invention is most suitable for filling and cleaning high-consistency pulp towers, bleaching towers, storage tanks and similar towers containing fiber suspensions, within the wood-processing industry.

Pulp towers within the wood-processing industry are in most cases tanks containing high-consistency pulp, whose consistency is about 10-20 percent, occasionally also pulp of low consistency, and which are used, e.g., for pulp storage or processing. Moreover, pulp towers are used as a blow tank for some devices or to store, e.g., pulp arriving periodically from batch digesters, which pulp is used as a steady flow in following processing devices. In other words, it is characteristic of the towers of the invention that they are basically large (diameter is generally on the order of 4-12 meters, and their height around 20-30 meters, although both smaller and larger towers exist), and that their surface level varies greatly, even if in most cases they have an optimal surface level, and it is generally desired to maintain the pulp surface at that level.

Many problems have been observed concerning the use of these towers or tanks. They relate mainly to the filling or emptying of the towers, or the inside fouling of the tower due to the stored or processed material adhering to the wall of the tower. In the following, the focus will be on discussing how the tower is filled and its fouling prevented, which is the subject matter of the present invention.

Many different solutions for filling the towers of the type mentioned above are previously known. The oldest known methods consist in pumping pulp to the top of the tower and allowing it to fall more or less directly downward. If pulp is allowed to fall directly downward on top of existing pulp, it is obvious that the pulp falling from above will pass through the surface of the pulp layer in the tower and penetrate deep into the old pulp. This gives rise to many disadvantages. First of all, if pulp dilution is performed at the tower bottom, as is very often the case, the pulp fed into the tower may penetrate as far as to the dilution zone. Hence pulp is discharged uncontrollably into the dilution zone, and dilution uniformity no longer corresponds to the requirements of the apparatus downstream of the tower. Another problem is that the pulp penetrating into the old pulp drifts closer to the tower discharge opening than does the pulp already in the tower, so that the content of the tower will not be evenly changed-instead a part of the pulp is carried out of the tower in a few minutes while a part of the pulp remains in the tower in the worst case even for days or weeks. More problems ensue in turn from this. First of all, it is impossible to imagine that pulp staying in the tower for days or even weeks may retain a quality similar to that of fresh pulp. Secondly, performing a complete change of grade in such towers may take days, or at best several hours, whereby the pulp discharged from the tower during the change period is a mixture of the new and old pulp grade. Depending on the subsequent use of the pulp, this so-called intermediate pulp may, in the worst case, be completely useless. Furthermore, old pulp remaining for a longer period in the same place in the tower, and new pulp flowing therethrough and deeper into the tower, gradually allow liquid to seep away from the surface of the pulp layer, whereby the surface layer hardens and may become more easily decayed. At the same time, old pulp also adheres more easily to the tower walls, from which it may detach as large solid pieces, which no longer disperse properly at the dilution zone of the tower.

Of course, the pulp may also be discharged into a distributor, e.g. a rotating disk arranged on top of the tower (e.g., SE-B-463 030), which distributes the pulp more evenly over the whole cross-section of the tower. While the distributor disperses the pulp flow into droplets, or at least relatively small-sized particles, a considerable amount of air is bound to the pulp as it descends, which air must be removed at a later stage of the process by vacuum pumps or by similar systems consuming a great deal of energy. In some towers, the pulp is carried from below to the bottom of a rotating disk provided with vanes (SE-C-502,971) so that the vanes spread the pulp over the cross-section of the tower. The publication states that the rotational speed of an electric motor used to rotate the disk may be changed in order to obtain the various degrees of spreading, whatever this means. This procedure is affected by the same problems as the rotating disk; i.e., the pulp forms droplets and a great deal of air is bound to the pulp. Another problem that may be mentioned is that rotating disks or the like described in the prior art do not allow for surface level variations in the tower, and instead are only suitable at some constant surface level, which practically in most cases means a full tower, whereby the disk or the like is placed only a little above the surface of the pulp in the tower. In an emptier tower the rotating disk throws the pulp against the wall of the tower, whereby it at the latest falls into drops and absorbs a great amount of air.

U.S. Pat. No. 4,278,496 discloses a filling arrangement for a bleaching tower within the pulp industry, wherein pulp is delivered to the tower through a rotating pipe fitting such that the pulp is spread in layers in the tower. However, this is a continuous process, where the surface level in the tower remains practically constant, and it is not critical that the pulp be spread out completely evenly into the tower, since the consistency of the pulp delivered to the tower is in the HC [high-consistency] area, in other words according to the publication, between 35 and 50 percent. With such high consistencies, there is no substantial danger of the pulp permeating deep into the pulp layer already in the tower, when the direction of pulp feed is not completely vertical. Nor is the mixing of the air into the pulp of any significance, since high-consistency pulp inherently contains large amounts of air.

A further problem that is not addressed concerns the storage of the bleached pulp. In some cases, it is namely of paramount importance that the pulp be discharged from both the bleaching tower and a possibly following storage or blow tank to ensure that the time the pulp stays in the tower or tank is kept constant. In other words, no part of the pulp may be left standing in the tower, since this will compromise its quality in one way or another. It was found, among other things, that the brightness of the pulp is reduced when the surface in the tower is lowered. This means in practice that the longer the pulp stays in the tower, the lower its brightness will be, or in the optimal case, the aim would be to discharge pulp from the tower in exactly the same order as it was fed in, or to maintain the time the pulp stays in the tower constant. It was furthermore observed that restarting the filling of the tower according to a prior-art method (direct blow via the top of the tower) increases the brightness of the pulp removed from the tower very quickly again. The only explanation for this would be that the blow coming from the tower continues almost directly to the tower discharge opening, whereby the pulp remaining in the tower will stay at the areas closer to the tower wall and not reach the tower discharge in time for removal.

Finnish patent application 971330 deals with a feed device, which aims to solve as efficiently as possible the problems of the previously described prior art devices. The apparatus in question includes a rotating feeder means arranged in connection with the upper part of the pulp tower, preferably its top or cover, preferably a central shaft relative to the tower, devices for its rotation, devices for delivering the pulp to the feeder means, as well as devices for controlling the operation of the feeder means. The devices for delivering pulp to the tower, except for the pipe leading through the cover, may also consist of a pipe extending through the side wall of the tower substantially to the central shaft of the tower, or the like. A pulp feeder means according to a preferred embodiment of the invention discussed in the publication consists of an elbow pipe arranged at the bottom end of a vertical pulp pipe or a similar entering the tower from above, the discharge opening of the elbow being substantially directed toward the wall of the tank or pulp tower. An important feature of the feeder means of the preferred embodiment described above is that its form does not disperse the pulp flow, i.e. produce sprinkles—instead the aim is to keep the pulp flow uniform, preventing as much as possible the binding of air among the pulp. It is not essential for the invention described in the publication that the discharge opening of the elbow pipe is in the horizontal direction, or tilted slightly up or down, but the direction of the pulp discharged from the discharge opening, along with the rotational speed of the feeder means, should ensure that under all operating conditions of the tower, pulp is discharged also to the proximity of the tower wall. The rotating device for the feeder means is preferably an electric motor with adjustable rotational speed, and optionally provided with a reduction gear. The control devices mentioned for the operation of the feeder means consist of a level sensor and a control unit, as standard equipment for each tower.

Thus it is possible with at least one or perhaps more of the devices mentioned above to feed pulp into the tower such that the tower is filled evenly from above, and the pulp fed to the tower cannot penetrate directly from the feed into the dilution zone.

Another problem with towers is, as pointed out previously, the adhesion of pulp to the tower wall. In practice, this always occurs, i.e. regardless of whichever device is used to feed pulp to the tower. When the pulp has adhered to the wall of the tower, it gradually dries and hardens, whereby it detaches as hard flaky lumps. These lumps do not necessarily disperse sufficiently in the dilution zone, but are instead carried forward to the pump and through it further into the process, where they hamper the process. Another disadvantage, which these cakes of pulp adhered to the wall of the tower may cause, is pulp deterioration. If the pulp remains in the tower for a sufficiently long period, the favorable conditions in the tower, i.e. temperature and moisture, promote deterioration of the pulp due to the influence of various microbes. The deterioration of the pulp may lead to greater pulp lots being deteriorated and also compromise the quality of the end product, unless the problem is noticed and corrected in a timely fashion.

For the above reasons, among other things, the cleanliness of the pulp towers is checked periodically, and the towers are cleaned either manually or by various washing devices arranged in the pulp towers, the washing operation being either continuous or intermittent. Among the washing methods used, manual washing, usually performed with a pressure washer, is the traditional way of handling this. This, however, involves problems of its own. First of all, it is almost impossible to perform washing when the process is ongoing, so that in practice cleaning is limited only to any downtime. Moreover since washing is manual, it is expensive and also somewhat hazardous work.

Thus, to clean the tower, various mechanical devices are proposed, most of which are based on the use of pressurized water or, more broadly, pressurized washing liquid in the washing of the tower. In principle, the devices come in three basic types. There are fixed nozzles and spray pipes, from which washing liquid is sprayed onto the desired portion of the tower wall. Moreover, there are rotating nozzle devices in connection with the cover of the tower, preferably arranged at the central shaft of the tower, where there generally are a large number of pressure liquid nozzles fixed on one or more stems producing the desired washing action in the tower. Further, fixed washing devices are known, consisting of a more or less round distributing chamber, a large number of nozzles being provided at its walls in such a way that they will cover the area to be washed in the inner surface of the tower.

The solutions known from the prior art, however, have their own problems. First of all, the fixed nozzles placed on separate sides of the tower have a relatively complex design requiring ramified liquid piping and numerous attachments, or in some cases, even numerous inlets through the cover of the tower. Also, when using the rotating feed devices known from the patent publications mentioned above, there is the risk of a pulp jet discharging from the feed devices breaking the nozzle pipes, or at least clogging the nozzles. A similar problem also concerns other solutions, in which the nozzle devices are exposed to a pulp jet. Thus, no matter how the washing devices according to the prior art are placed in the tower, there is great risk that they will either become clogged and/or break down due to the action of the pulp that is fed into the tower. Moreover, when the tower filling devices are located at the tower centerline, prior art nozzle solutions to be placed in the same way at the tower centerline, whether rotating or fixed, cannot be placed at the same point, but instead they need to be installed at the side of the tower centerline, thus in turn becoming exposed to the pulp jet.

SUMMARY OF THE INVENTION

The various problems of the previously described prior art solutions may be solved by the method and apparatus according to our invention.

Using the method and apparatus according to the invention, the filling and cleaning of the pulp tower may be done almost without any supervision at all. The washing apparatus is placed so that the pulp jet may neither break nor clog the washing device or its nozzles. The apparatus according to the invention is simple because it exploits already existing structures, as much as possible. Hence, if the tower already has a rotating feed device, its drive mechanism, and the attachment, sealing and bearings provided for it at the cover of the tower, may also be used when installing the device according to the invention.

The invention will be described below in more detail in reference to the attached drawing.

BRIEF DESCRIPTION OF THE DRAWINGS

The FIGURE is an elevational view of an exemplary apparatus for filling and cleaning a pulp tower.

DESCRIPTION OF THE PREFERRED EMBODIMENTS

The apparatus according to the invention comprises, according to the FIGURE, a filling unit 12 provided at the top of the pulp tower, preferably at the cover of the tower 10, preferably placed centrally to the shaft of the tower, the filling unit being provided with a lid 14, and one or more connections 16 located at the side of the unit for a pipe or pipes delivering pulp to the tower. Inside the unit 12 below this connection there is situated preferably, but not necessarily, a baffle 18 or a funnel guiding pulp entering the tower from the connection 16 in the direction of the shaft of the tower. The lid 14 of this filling unit is provided with a seal and a bearing 20 on a shaft 22, below which there is fastened a scooping feeder means 24, which may be, e.g., an elbow pipe, whose discharge opening or edge is substantially directed toward the wall of the tank or pulp tower. An important feature of a feeder used in connection with the invention is that in terms of its form, it does not disperse, i.e. sprinkle, the pulp flow—instead the aim is to keep the pulp flow uniform and prevent as much as possible binding of the air among the pulp. It is not essential, for the feeder means according to the present invention, whether the direction of feed of the feeder means 24 is horizontal, or titled slightly up or down, but the direction of the pulp discharged from the discharge opening, along with the rotational speed of the feeder means 24, should ensure that under all operating conditions of the tower, pulp is discharged also to the proximity of the tower wall. The rotating device 26 of the feeder means, which according to a preferred embodiment of the invention is preferably a speed-adjustable electric motor, which may optionally be provided with a reduction gear, is arranged outside the tower either in connection with the unit 12 or at a distance from it (as shown in the FIGURE).

This feeder means 26 according to a preferred embodiment of the invention is rotated, e.g. so that the rotational speed of the feeder means is changed both relative to the tower diameter and according to the surface level in the tower. Thus, with each pulp surface level in the tower, the rotational speed of the feeder means is changed such that the feeding of the pulp to the tower occurs at its maximum distance to the vicinity of the tower wall, without the pulp jet hitting the tower wall, and at its minimum close to the shaft of the tower. When the surface level decreases from the one described above, the rotational speed of the feeder means is reduced, since already with the lower rotational speed the pulp jet discharging from the feeder means extends to the vicinity of the tower wall. Similarly, when the surface level rises, the rotational speed is increased.

The apparatus according to the invention includes furthermore an axial channel 28 arranged in the shaft 22 of the feeder means 24, at the upper end of which channel there is a rotating coupling arrangement 30 for delivering washing liquid to the channel 28. This coupling arrangement may be such, as represented in the FIGURE, that at a suitable point along the length of the shaft, there is a substantially radial opening in the shaft arranged for carrying washing liquid to a preferably, but not necessarily, central washing-liquid channel of the shaft, or the coupling arrangement may optionally be placed at the upper end of the shaft. It is, of course, possible also to arrange this channel outside the shaft, even if the technical implementation is significantly more complex. Similarly, the shaft 22 is equipped at its lower section with devices 32 for carrying washing liquid from the shaft channel 28 to nozzles. By means of washing-liquid jets discharging from the nozzles either the tower walls or the tower ceiling or both are kept clean. These devices 32 carrying washing liquid are formed by one or more pipes permanently fastened to the shaft or the feeder means 24, which pipe/s is/are provided with nozzles preferably so that they will not directly contact the pulp that is fed into the tower. One possibility is therefore, as shown in the FIGURE, to place both the devices 32 carrying washing liquid and the nozzles at the back, so that in practice the feeder means 24 feeds the pulp in the opposite direction relative to the washing nozzles.

Depending on the size of the tower, the washing arrangement of the tower according to the invention may also, except for the nozzle pipe 32 in connection with the nozzle arrangement shown in the FIGURE, consist of a solution in which one or more pipes are fastened on the shaft 22 or the feeder means (when the pipe is fastened on the feeder means 24, devices for carrying washing liquid from the channel 28 of the shaft 22 to the pipe are needed), the pipe/s carrying the washing liquid to a proper nozzle system located further away from the shaft, and the pipes at the same time acting as supports for the nozzle system—or of a solution where one or more nozzles are arranged in direct connection with the feeder means 24, and by means of the nozzle/s, both the walls and the ceiling of the tower, or either one of them, may be kept clean. The nozzle arrangement mentioned above may, e.g., be a larger chamber located at the end of one or more pipe/s delivering washing liquid, several nozzles having been fastened at the walls of the chamber—or one or more transversal pipe/s provided with one or more nozzles, the pipe/s having been fastened to one or more pipe/s at its/their opposite end/s with regard to the shaft 22 or in proximity thereof.

As a further embodiment of the invention, an apparatus may be devised where in connection with the top of the tower, regardless of whether the tower is provided with a ceiling or a cover, or whether the tower is open at the top, there is arranged a feeding and washing device, which is either continuously or intermittently rotating. This device may preferably, but not necessarily, consist of, e.g., a vertical pipe located in the middle of the tower, the bottom of the pipe being sealed except for a few (e.g., three or four) feed pipes arranged at regular intervals to the circumference of the pipe, from which pipes pulp is discharged at a desired distance toward the side wall of the tower. Between the relevant feed pipes either directly in contact with a vertical pipe or arranged via a stem at a distance therefrom there is arranged a suitable nozzle apparatus, with which the space surrounding the feeding and washing apparatus of the tower is washed. This space refers either to the tower wall, the suspension device of the feeding and washing apparatus, the ceiling of the tower, or any other structure inside the tower, or some combination thereof. The relevant feeding and washing apparatus may be rotated continuously, and at a variable speed, whereby the device is essentially operated the same way as in the previous embodiment; i.e., the distance at which pulp is fed depends on the rotational speed of the feed device.

This embodiment also affords the possibility of keeping the feed device stationary for a while, which, of course, is also possible with the previously discussed embodiment shown in the FIGURE. The idea is now that the tower is filled a few sectors at a time, at the same time as the space surrounding the feed and washing device is washed from the area of the remaining sectors. Characteristic of both this and the prior embodiments of the invention is that the washing process need not be continuous, instead the washing may be pre-set to occur in a desired way, e.g. according to the degree of fouling of the tower.

A feed device feeding in several directions may, except for the previously described sealed-pipe, also be of the open scoop type, as shown in the FIGURE, in which there are several scoops, however. Thus, the washing devices are placed between the scoops, and the feeding of the washing liquid occurs in different directions relative to the directions in which the pulp is fed.

It should be further noted that the washing arrangement according to the invention may be suspended in a tower without any ceiling or cover. This means that both the pulp feeder arrangement and the washing apparatus for the tower walls are suspended either on the tower walls or on a special support structure arranged either in connection therewith or outside thereof.

As can be understood from the above a new method and apparatus for filling/cleaning pulp towers has been designed which corrects the numerous drawbacks of prior art apparatus and methods. However, only a few advantageous embodiments of the invention have been described above, which do not limit the scope of the invention from what has been defined in the appended patent claims.

The invention claimed is:

1. An apparatus for filling and cleaning a pulp tower, comprising:

a rotatable feed device configured for feeding pulp into the tower, comprising:

a shaft, and a pulp feeder means at the lower end of the shaft; and a washing device connected to the feed device, configured to wash the space surrounding the feed device, the washing device comprising a washing liquid channel arranged in connection with the shaft, and at least one pipe for carrying washing liquid from the channel to washing nozzles.

2. An apparatus according to claim 1, wherein the feeder means and washing device are placed so that feeding of the washing liquid and the pulp into the tower occurs substantially in different directions.

3. An apparatus according to claim 2, wherein the pipe for carrying washing liquid from the channel to the washing nozzles is fastened on the shaft and provided with the washing nozzles.

4. An apparatus according to claim 2, wherein the pipe for carrying washing liquid from the channel to the washing nozzles is fastened on the shaft or the feeder means, wherein the pipe carries the washing liquid to a nozzle system located away from the shaft, and wherein the pipe acts as a support for the nozzle system.

5. An apparatus according to claim 1, wherein the channel extends along the shaft to outside of the tower, the apparatus further comprising a rotating connector outside of the tower, configured to carry washing liquid to the channel.

6. An apparatus according to claim 1, wherein said channel is inside the shaft.

7. An apparatus according to claim 1, further comprising one or more washing nozzles for washing an inside wall or ceiling of the tower arranged in connection with the feeder means.

8. An apparatus according to claim 7, wherein the washing nozzles are arranged such that they will not come into contact with a pulp jet discharging from the feeder means.

9. An apparatus according to claim 1, wherein the feed device comprises a drive mechanism of the feeder means, whose rotational speed is controlled by a control unit.

10. An apparatus according to claim 1, wherein the feeder means has an adjustable rotational speed.

11. An apparatus according to claim 1, wherein the feed device further comprises a tower level sensor and a control unit.

12. An apparatus according to claim 1, wherein the feeder means and the washing device rotate intermittently.

13. An apparatus according to claim 1, further configured such that a pulp jet fed by the pulp feeder means does not hit a wall of the tower.

* * * * *